United States Patent [19]

Kinney

[11] Patent Number: 5,031,345

[45] Date of Patent: Jul. 16, 1991

[54] MOVING DISPLAY SCISSORS

[76] Inventor: William J. Kinney, 6520 Woodland Dr., Dallas, Tex. 75225

[21] Appl. No.: 409,707

[22] Filed: Sep. 20, 1989

[51] Int. Cl.[5] ..... A47F 11/06; B44F 1/00; G09F 19/12

[52] U.S. Cl. ..... 40/427; 40/545; 40/414; 40/432; 40/614

[58] Field of Search ..... 40/470, 584, 411, 414, 40/416–420, 427, 429, 614, 545, 430, 431, 432, 553

[56] References Cited

U.S. PATENT DOCUMENTS

| | | | |
|---|---|---|---|
| 769,348 | 9/1904 | Junghans | 40/427 |
| 2,005,421 | 6/1935 | High | 40/432 |
| 2,036,147 | 3/1936 | Klema | 40/470 |
| 2,146,944 | 2/1939 | Eckel | 40/432 |
| 2,155,618 | 4/1939 | Roberts | 40/432 |
| 3,200,522 | 8/1965 | Clement | 40/432 |

FOREIGN PATENT DOCUMENTS

| | | | |
|---|---|---|---|
| 333586 | 1/1936 | Italy | 40/431 |

*Primary Examiner*—Laurie K. Cranmer
*Assistant Examiner*—J. Hakomaki
*Attorney, Agent, or Firm*—Johnson & Gibbs

[57] ABSTRACT

A display scissors having two elongate members which are movable with respect to one another. The first elongate member has one end portion configured to represent a first blade element of a scissors and an opposite end portion configured to represent a first loop element of the scissors. The first loop element is curved in a clockwise direction. The second elongate member has one end portion configured to represent a second blade element of the scissors and an opposite end portion configured to represent a second loop element of the scissors. The second loop element is curved in a counter-clockwise direction. The second blade element is positioned generally parallel to the first blade element and points in a similar direction to that of the first blade element. The display scissors includes mounting means for pivotally moving the first elongate member in one direction and simultaneously and pivotally moving the second elongate member in an opposite direction about a common axis.

5 Claims, 4 Drawing Sheets

MOVING DISPLAY SCISSORS

BACKGROUND OF THE INVENTION

The invention relates to a moving scissors display that opens and closes and, more particularly, to a moving display neon scissors.

HISTORY OF THE PRIOR ART

Most retail shops have window signs which are designed to inform pedestrians at a glance as to the nature of the business conducted by the shop. Hopefully passersby will be attracted by the window sign, step into the shop and eventually become a customer of it. Window signs are, thus vital to the survival of many small retail shops and often their only means of advertising. A mundane window sign will rarely attract the attention of preoccupied pedestrians who are most often in a hurry to get to their destination. Unless something strongly attracts their attention to a particular shop, they will neither notice it nor become its customers. Beauty salons and barbershops are no different from other retail shops in this respect that their survival depends on the number of customers they attract. The more customers who notice them and stop by, the better their business.

Historically, a barber pole display has been used as a symbol of a barbershop and as a means to attract customers. A barber pole is usually constructed as a vertical rotating pole covered with red and white or red, white and blue diagonal stripes. Such barber poles have been in existence for so long a time and have been so extensively used that they have lost their uniqueness. They tend to blend in with other backgrounds and building decorations. Unless passersby are specifically looking for a barber pole, they are unlikely to even notice its existence. Barber poles have simply lost their ability to attract the attention of passersby and to serve as an effective attention getting advertising medium for hair salons. The animated display of the present invention overcomes this shortcoming.

SUMMARY OF THE INVENTION

The display scissors of the present invention includes two elongate members which are movable with respect to one another. The first elongate member has one end portion configured to represent a first blade element of a scissors and an opposite end portion configured to represent a first loop element of the scissors. The first loop element is curved in a clockwise direction. The second elongate member has one end portion configured to represent a second blade element of the scissors and an opposite end portion configured to represent a second loop element of the scissors. The second loop element is curved in a counter-clockwise direction. The second blade element is positioned generally parallel to the first blade element and points in a similar direction to that of the first blade element. The display scissors includes mounting means for pivotally moving the first elongate member in one direction and simultaneously and pivotally moving the second elongate member in an opposite direction about a common axis.

In another aspect, the moving display scissors of the present invention comprises a pair of elongate members, each having a loop at one end, and each being a mirror image of the other. In operation, the two elongate members pivotally move in opposite direction about a common axis and create the appearance of the movement of the opening and closing of a pair of scissors.

Accordingly, it is an object of the present invention to provide an eye-catching moving scissors display that opens and closes to be used as a storefront sign.

Another object of the present invention is to provide a pair of moving display neon scissors that opens and closes, symbolizing the hair-cutting system.

Still another object of the present invention is to provide a pair of moving display scissors that opens and closes to identify a shop as a hair salon and to create a visual imprint of the location of the shop.

A further object of the present invention is to provide a pair of moving display scissors that is free-standing, powered by household current and can be displayed in most store-front windows, salon trade shows, hair style shows, and other exhibits.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION OF THE DRAWINGS

Figure 1:
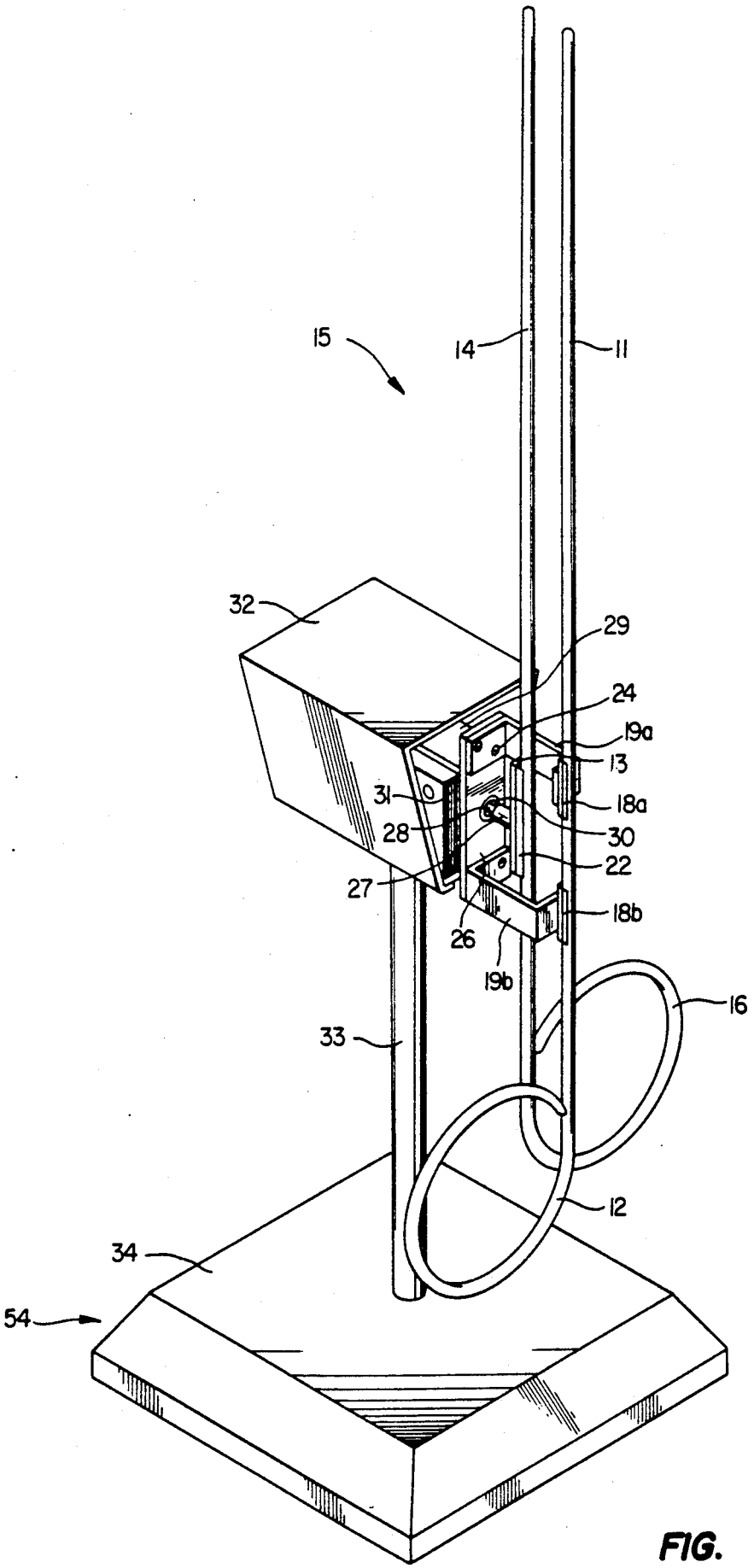
FIG. 1 is a perspective view showing a moving display scissors constructed in accordance with the teaching of the present invention in a closed configuration.

Referring first to FIG. 1, there is shown a perspective view of a moving display scissors 15 constructed in accordance with the teachings of the present invention. The display scissors 15 is shown in a closed configuration and consists of two eleongate members 11 and 14. The first elongate member 11, the left elongate member, has its upper elongate end portion configured to represent a first blade element of a scissors and a first loop 12 located at the lower end and configured to represent a first loop element of the scissors 15. The left loop 12 curves in a clockwise direction. The second elongate member 14, the right elongate member, has its upper elongate end portion configured to represent a second blade element of the scissors and a second loop 16 located at the lower end and configured to represent a second loop element of the scissors. The right loop 16 curves in a counter-clockwise direction. Looking at the scissors 15 from the front and from a distance, the left elongate member 11 and the right elongate member 14 appear as the two cutting blades of a scissors while the two loops 12 and 16 appear as two finger receiving loop elements of a scissors. In this particular embodiment, the left member 11 is positioned slightly in front of the right member 14. The left elongate member 11 and the left loop 12 are oriented in a plane in close proximity and in parallel to the plane containing the right elongate member 14 and the right loop 16. The two planes are normally spaced a few inches apart from one another. Both the left elongate member 11 and the right elongate member 14 point upwardly in this particular embodiment.

Figure 7:
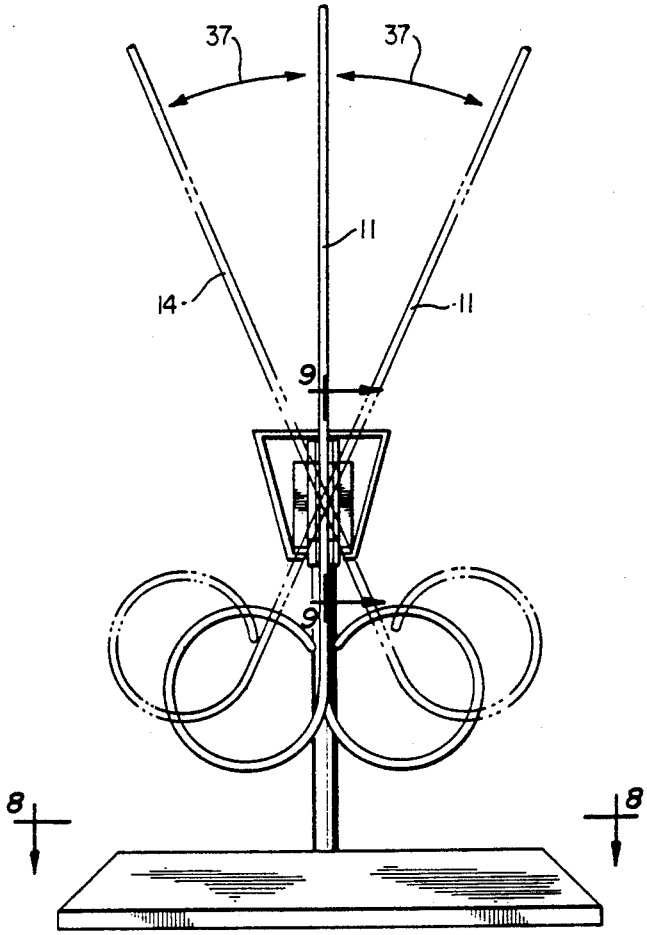
FIG. 7 is a perspective view of the moving display scissors shown in FIG. 1 with two elongate members shown in solid lines in a closed configuration and in phantom in an open configuration.

Still referring to FIG. 1, a bonnet 32 houses the mechanism for producing movement of the moving display scissors. The left elongate member 11 is attached to a bracket support arm 29, which is perpendicular to a bracket support plate 26 which mounts an upper tube bracket 19*a* and a lower tube bracket 19*b*. The tube brackets 19*a* and 19*b* roughly resemble the shape of a "C" while the upper tube bracket 19*a* faces toward the left while the lower tube bracket 19*b* faces toward the right. The upper tube bracket 19*a* mounts a resilient polyvinyl chloride ("PVC") shoe 18*a* which grips the upper portion of the left elongate member 11. Similarly, the lower tube bracket 19*b* mounts a resilient PVC shoe 18*b* which grips the lower portion of the left elongate member 11. Each of the tube brackets 19*a* and 19*b* is secured by means of bolts 24 to the bracket support arm 29. The right elongate member 14 is attached to a tube-tee plate 13 by means of a large PVC shoe 22. The tube-tee plate 13 is attached by means of a set screw (not shown) in a tube-tee shaft 27 to a front shaft 28 extending through a bearing 30 into gear box half 31. The front shaft 28, which pivots the right elongate member 14, passes through a central aperture formed in the bracket support plate 26. The front shaft 28 is spaced approximately equally from the two tube brackets, 19*a* and 19*b*, supporting the left elongate member 11. Thus, the pivot points of both the left elongate member 11 and the right elongate member 14 are concentric with one another and pivot about a common axis. In operation, the left elongate member 11 moves to the right and the right elongate member 14 moves to the left and when viewed from the front, as illustrated in FIG. 7, the two elongate members 11 and 14 appear to move past one another about a pivot near the tube-tee axis 27 by which they appear to be held together.

Still referring to FIG. 1, the bonnet 32 is supported by a neck 33 which sits on a second base 56 (not shown). For aesthetic reasons, the base is usually draped over by a base cover 34. The entire display unit 15 is free standing and can be placed behind a storefront window, and may also be used in salon trade shows, hair style shows and other exhibits. In one embodiment, the entire display has a total height of about 6'6", and the two elongate members 11 and 14 open to about 3 feet wide.

Both the left elongate member 11 and the right elongate member 14 can be made of 15 mm neon tubes. In operation, these neon tubes can be lighted by a 110 volt alternating current through a transformer which yields a 4000 volts and 30 mA output. The power from the transformer is channelled to the electrodes within the neon tubes via high voltage gaseous-tube wires (such as GTO). For aesthetic and safety purposes, the gaseous-tube wires enter the bottom portion of the neck 33 and emerge from the top portion of the neck 33 so that the gaseous-tube wires are not exposed unnecessarily. Narrow glass tubes can be glued to the back of each of the neon tubes to channel twisted and parallel copper wires, preferably of the 16 AWG type. Each of the gaseous-tube wires makes a connection with the two copper wires to conduct the current to the electrodes protruding from each terminal end of each of neon tubes making up the left elongate member 11 and the right elongate member 14. The two neon tubes are wired in series with each other.

In an alternate embodiment, the terminal end of the left elongate member 11 is further provided with a curvature bent at an angle and laying in a plane perpendicular to a plane defined by the left elongate member 11 and the left loop 12. Similarly, in this alternate embodiment, the terminal end of the right elongate member 14 is also further provided with a curvature bent at an angle and laying in a plane perpendicular to a plane defined by the right elongate member 14 and the right loop 16. In this embodiment, the electrodes from each of the elongate members will not be observable from the front.

Figure 2:
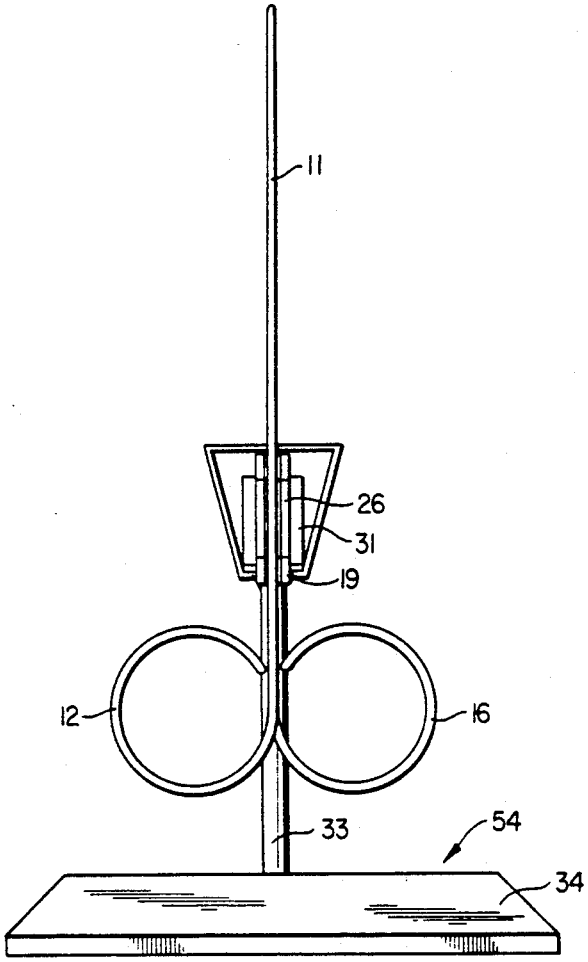
FIG. 2 is a front elevational view of the moving display scissors of FIG. 1.

Referring now to FIG. 2, there is shown a front elevational view of the moving display scissors of FIG. 1. Here, only the left elongate member 11 is visible from the front, with the sight of the right elongate member 14 being obscured by the left elongate member 11. Portions of the bracket support plate 26 and the two gear box halves 31 are visible from the front.

Figure 3:
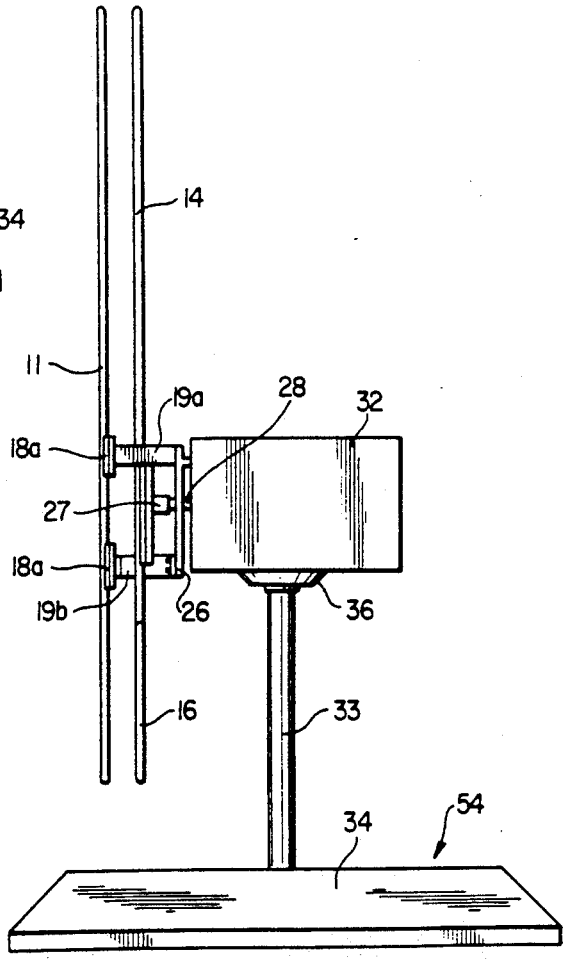
FIG. 3 is a left side elevational view of the moving display scissors of FIG. 1.

Referring to FIG. 3, there is shown a left side elevational view of the moving display scissors of FIG. 1. The bonnet 32 is supported by the neck 33 through a pipe flange 36. The parallel arrangement of the two elongate member 11 and 14 is clearly shown in this figure. The left elongate member 11 is fastened to two PVC shoes 18*a* and 18*b*, which, in turn, are attached to two tube brackets 19*a* and 19*b*. The right elongate member 14 is rotated about the tube-tee shaft 27 and the front shaft 28.

Figure 4:
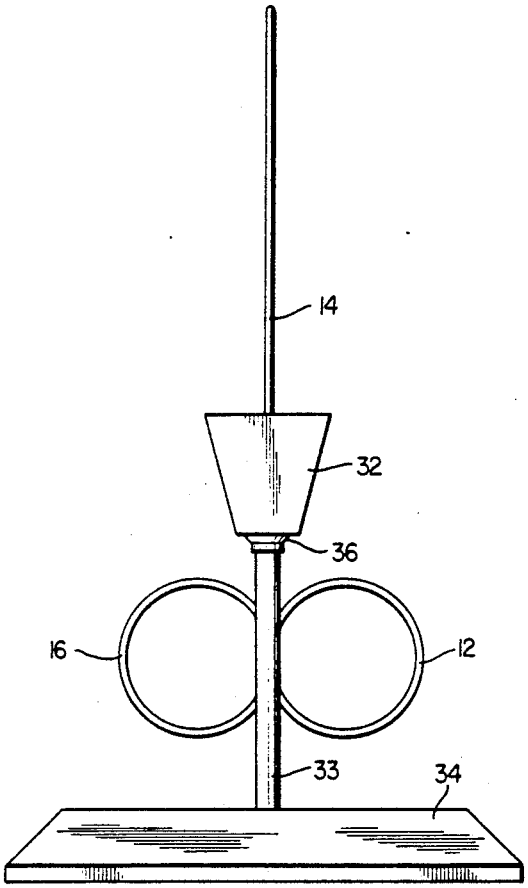
FIG. 4 is a rear elevational view of the moving display scissors of FIG. 1.
Figure 6:
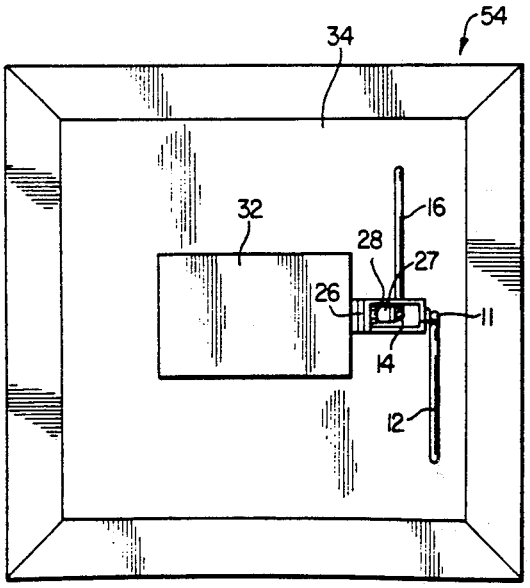
FIG. 6 is a top plain view of the moving display scissors of FIG. 1.

FIG. 4 shows a rear elevational view of the moving display scissors of FIG. 1. Viewed from the rear, the right elongate member 14 blocks the left elongate member 11 so that the left elongate member 11 is not visible.

Figure 5:
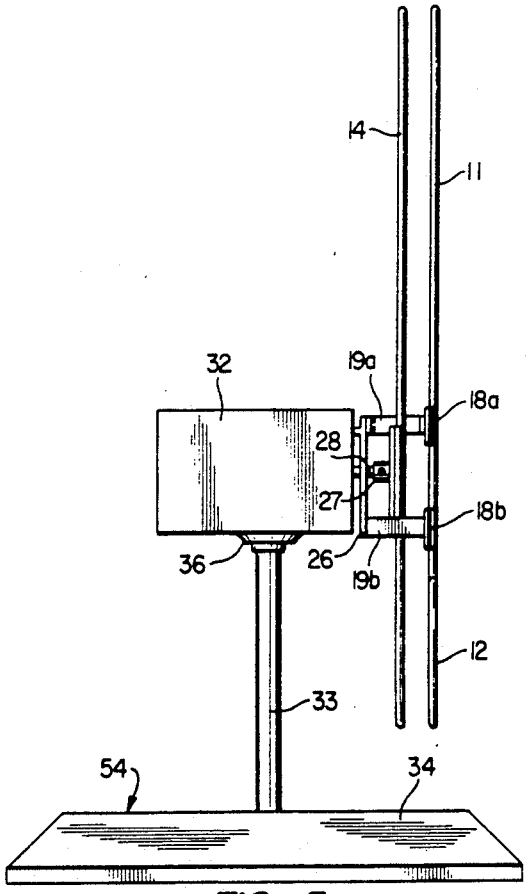
FIG. 5 is a right side elevational view of the moving display scissors of FIG. 1.

Referring now to FIG. 5, there is shown a right side elevational view of the moving display scissors of FIG. 1. The bonnet 32 is shown to be supported by the neck 33 via the pipe flange 36.

FIG. 7 shows a perspective view of the moving display scissors shown in FIG. 1 with two members 11 and 14 in an open configuration in phantom and in a closed configuration in solid lines. In the closed configuration, only the left elongate member 11 is visible from the front since the view of the right elongate member 14 is blocked by the left elongate member 11. In the open configuration, shown by phantom lines, the two elongate members 11 and 14 appear as two cutting blades of a pair of scissors moving past one another on a pivot near the center by which they are held together. In operation, the two elongate members 11 and 14 continuously oscillate in an opening and closing fashion in the directions shown by arrows 37, symbolizing the working scissors, namely, the continuous opening and closing of the two cutting blades of a pair of scissors.

Figure 8:
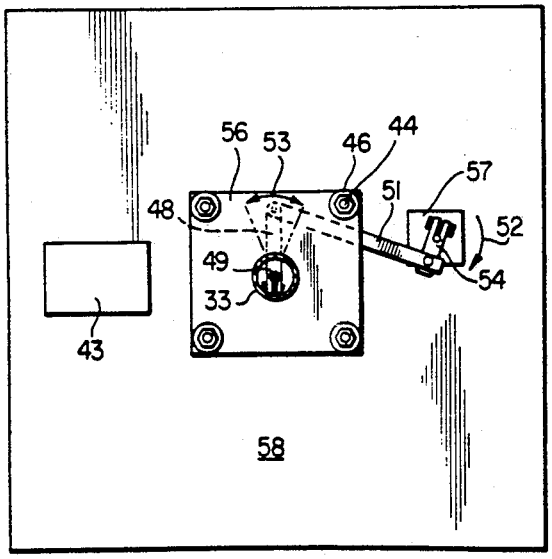
FIG. 8 is a top view of the base taken on the line 8—8 of FIG. 7 with the base cover removed.

Referring now to FIG. 8, there is shown a top view of the base 58 taken on the line 8—8 of FIG. 7. To one side of the base 58, a neon transformer is shown as a block 43. A second narrower base 56 is located near the central region of the under base 58. The second base 56 is secured to the base 58 by a plurality of thread nuts 44, washers 46 and threaded shafts. The neck 33 is represented as a circle 33 in the central region of the narrower base 56. The circular motion, indicated by arrow 52, of the motor 57 turns the motor arm 54 which pushes the drive arm 51 and causes the shaft arm 48 to pivot back and forth on the drive shaft 49. Thus, the drive shaft 49 oscillates through an arcuate motion, alternately clockwise and then counter-clockwise, approximately 60° each way as indicated by arrow 53.

Figure 9:
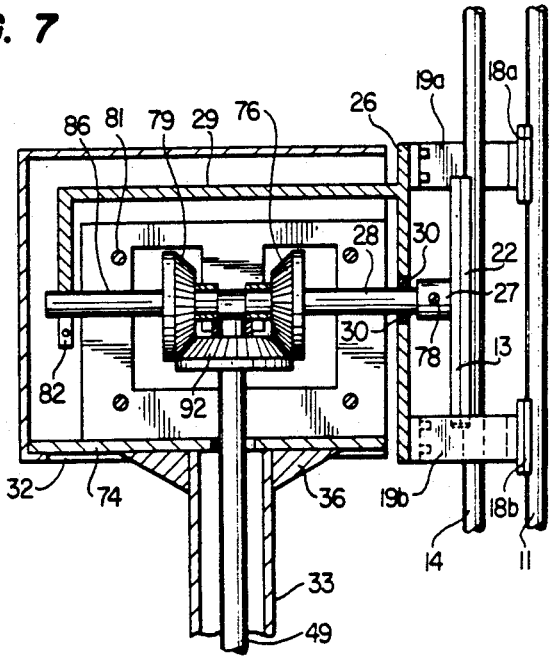
FIG. 9 is a cross-sectional view taken on the line 9—9 of FIG. 7 illustrating the gear mechanism for moving the scissors.

Referring now to FIG. 9, there is shown a cross-sectional view of the bonnet 32 taken along the line 9—9 of FIG. 7 and illustrating the rotational mechanism of the two elongate members 11 and 14. As a further support, a bonnet base 74 is provided on the bottom of the bonnet 32. The alternating clockwise and counter-clockwise arcuate motion of the drive shaft 49 is transferred to the front shaft 28 and the back shaft 86 via three gears, 92, 79 and 76. The back shaft 86 is directly connected to the back gear 79, while the front shaft 28 is directly connected to the front gear 76. The drive shaft 49 is directly connected to the drive gear 92. Suitable gears are 16 pitch miter gears with a 20° pressure angle, manufactured by Martin Gear Co. Gear box bolts 81 are used to hold the two gear box halves 31 together, holding three gears into place. The gear box is also bolted to the bonnet base 74. The back gear 79 and the front gear 76 face one another and both have a common rotational axis oriented horizontally. The drive gear 92 has its rotational axis oriented vertically and the drive shaft 49 is driven by a motor 57 (not shown). The three gears, 79, 76 and 92, are directly connected with one another. Both the front gear 76 and the back gear 79 are perpendicular to the drive gear 92. Because of the engagement of the teeth of these three gears with one another, when the drive gear 92 rotates, it rotates the front gear 76 in one direction and, at the same time, rotates the back gear 79 in an opposite direction.

Still referring to FIG. 9, the oscillating clockwise to counter-clockwise arcuate motion in the front shaft 28 makes the right elongate member 14 move in the same manner as the tube-tee axis 27 which supports the right member 14. Similarly, the clockwise to counter-clockwise motion of the back shaft 86 moves the bracket assembly comprising 29, 26, a bracket support clamp 82, and the left elongate member 11. The left elongate member 11 always moves in a direction which is opposite to that of the right elongate member 14. The left elongate member is supported by the two tube brackets **19*a* and 19*b*. The bracket support assembly (29, 26, and 82) is also supported by a bearing 30 situated between the bracket support plate 26 and the front shaft 28 while the tube-tee shaft 27 is bolted to the front shaft 28 by set screw 78**.

As discussed above, it is clear that the elongate members of the present moving display scissors can open and close giving the appearance of the opening and closing of the blades of a pair of giant scissors. The display of the present invention can be used as an attractive storefront sign to attract the attention of passersby and to indicate the presence of a hair-cutting shop. The moving display scissors may also be used in salon trade shows, hair style shows and other exhibits.

It is thus believed that the operation and construction of the present invention will be apparent from the foregoing description. Although the method and apparatus shown and described has been characterized as being preferred, it will be obvious that various changes and modifications may be made therein without departing from the spirit and scope of the invention as defined in the following claims.

I claim:

1. A display scissors comprising:

a first elongate member comprising a first illuminated neon tube and having a first end portion configured to represent a first blade element of said scissors and a second end portion configured to represent a first loop element of said scissors, said first loop element being curved in a clockwise direction;

a second elongate member comprising a second illuminated neon tube and having a first end portion configured to represent a second blade element of said scissors and a second end portion configured to represent a second loop element of said scissors, said second loop element being curved in a counter-clockwise direction;

means for mounting said first and second elongate members at a location intermediate to each of their respective end portions for arcuate movement within parallel planes about a common axis; and means for moving said first elongate member about its pivotal axis through an arcuate path in one direction and simultaneously moving said second elongate member about its pivotal axis through an arcuate path in an opposite direction to create a visual impression of the appearance of working scissors.

2. A display scissors as set forth in claim 1 wherein said mounting means comprising:

means for supporting said first elongate member comprising:

a bracket support arm mounted for arcuate movement about said axis;

a bracket support plate extending perpendicularly from said bracket support arm;

a first resilient shoe for gripping said first elongate member;

a C-shaped tube bracket having a first end connected to said first shoe and a second opposed end connected to said bracket support plate; and means for supporting said second elongate member comprising:

a tube-tee shaft mounted for arcuate movement about the same axis as said bracket support plate and extending through a clearance opening therein to allow independent movement therefrom;

a tube-tee plate attached to the end of said tube-tee shaft and extending perpendicularly therefrom;

a second resilient shoe connected to said tube-tee plate for gripping said second elongate member and allowing relative arcuate movement of said first and second elongate members about said common axis.

3. A display scissors as recited in claim 2 further comprising:

a drive shaft having a drive gear connected to one end thereof and extending perpendicularly to the axis of said tube-tee shaft;

a back shaft having a back gear connected to one end and the other end connected to said bracket arm to move said arm through an arcuate path, said back shaft and said tube-tee shaft lying along said common axis;

a front gear connected to the end of said tube-tee shaft and in engagement with said drive gear; and means for moving said drive shaft through an arcuate path to cause said back shaft to rotate in one direction and simultaneously cause said front shaft to rotate in an opposite direction to move said first and second elongate elements in opposite directions.

4. A display scissors comprising:

a first elongate illuminated neon tube having a first end portion configured to represent a first blade element of said scissors and a second end portion configured to represent a first loop element of said scissors, said first loop element being curved in a clockwise direction;

a second elongate illuminated neon tube having a first end portion configured to represent a second blade element of said scissors and a second end portion configured to represent a second loop element of said scissors, said second loop element being curved in a counter-clockwise direction;

means for mounting said first and second elongate illuminated tubes at a location intermediate to each of their respective end portions for arcuate movement within parallel planes about a common axis; and means for oscillating said first elongate illuminated neon tube about its axis of movement through an arcuate path in one direction and then through an arcuate path in the opposite direction, and simultaneously oscillating said second elongate illuminated tube about its axis of movement through an arcuate path in a direction opposite to the direction of movement of said first elongate illuminated neon tube to create a visual impression of the appearance of working scissors.

5. A display scissors as set forth in claim 4 wherein said arcuate path comprises approximately 60° l of arc.

* * * * *